US005597977A

United States Patent [19]

Chattopadhyay

[11] Patent Number: 5,597,977

[45] Date of Patent: Jan. 28, 1997

[54] HARDENED POROUS AMMONIUM NITRATE

[75] Inventor: Arun K. Chattopadhyay, Brossard, Canada

[73] Assignee: ICI Canada, Inc., Ontario, Canada

[21] Appl. No.: 547,989

[22] Filed: Oct. 25, 1995

Related U.S. Application Data

[63] Continuation of Ser. No. 878,720, May 4, 1992, abandoned.

[51] Int. Cl.[6] ..... C06B 31/28

[52] U.S. Cl. ..... 149/6; 149/46; 149/7

[58] Field of Search ..... 149/6, 7, 46

[56] References Cited

U.S. PATENT DOCUMENTS

| | | | |
|---|---|---|---|
| 3,112,233 | 11/1963 | Friedman et al. | 149/6 |
| 3,190,775 | 6/1965 | Ender | 149/6 |
| 3,395,055 | 7/1968 | Sparks et al. | 149/6 |
| 3,480,488 | 11/1969 | Rudy et al. | 149/6 |
| 3,770,390 | 11/1973 | Teot | 423/366 |
| 3,816,191 | 6/1974 | Wilson et al. | 149/46 |
| 3,830,672 | 8/1974 | Lista | 149/7 |
| 3,856,933 | 12/1974 | Jankowiak | 424/42 |
| 4,151,022 | 4/1979 | Donaghue et al. | 149/19.4 |
| 4,384,903 | 5/1983 | Enever | 149/7 |
| 4,555,278 | 11/1985 | Cescon et al. | 149/21 |
| 4,615,751 | 10/1986 | Smith et al. | 149/2 |
| 4,718,954 | 1/1988 | Machacek et al. | 149/46 |
| 4,756,738 | 7/1988 | Detroit | 71/27 |
| 4,875,949 | 10/1989 | Mishra et al. | 149/19.3 |
| 4,992,119 | 2/1991 | Carlsen et al. | 149/46 |
| 5,041,177 | 8/1991 | Hajto et al. | 149/46 |
| 5,123,981 | 6/1992 | Mullay et al. | 149/7 |

*Primary Examiner*—Edward A. Miller

[57] ABSTRACT

The present invention is directed to hardening ammonium nitrate by combining ammonium nitrate with a functionally active polymer. A functionally active polymer may be combined with ammonium nitrate by itself as a shell or intermixed with the ammonium nitrate. The invention is found useful in hardening ammonium nitrate for use in explosives.

12 Claims, No Drawings

HARDENED POROUS AMMONIUM NITRATE

CROSS REFERENCE TO RELATED APPLICATIONS

This application is a continuation of Ser. No. 07/878,720 filed May 4, 1992, now abandoned.

BACKGROUND

The present invention is directed to hardening ammonium nitrate without affecting other important physical properties.

A problem in the ammonium nitrate art is the competing need for porosity versus the need for hardness. This is especially true for ammonium nitrate bodies that can be used for explosive applications. Bodies of ammonium nitrate means but is not limited to formulations of ammonium nitrate, physical forms, such as prills, granules, or said prills and/or granules in an emulsion, and compositions wherein ammonium nitrate is a major component. Ammonium nitrate may be used for other applications such as fertilizers, wherein porosity is not an important property, in fact, it is undesirable. Hardness is important for fertilizers since hardness is related to the leaching rate of the fertilizer into the soil. Therefore, hardness is important for both explosive and fertilizer applications. Those skilled in this art know that hardening or the lack thereof of ammonium nitrate bodies for the purposes of storage and/or for their transportation to end-use destinations has been a problem in this art for sometime.

Hardness for ammonium nitrate (AN) bodies is generally defined by crushing strength, which is tested by providing a constant load on the body until the body is crushed or cracked. Friability is also a measure of hardness. Friability, as determined by the method described hereinbelow, is the characterization of the hardness of the outside surface of the body. Porosity may be determined by characterizing particle density as can be measured by mercury pyknometry.

The present invention advances the ammonium nitrate art with the application of polymers, organic, inorganic and/or combinations thereof to produce a hardened ammonium nitrate previously unknown to this art. The ammonium nitrate of the present invention may be used for any application where hardness is important. This is especially true for the explosive and the fertilizer arts used in the body of a prill.

SUMMARY OF THE INVENTION

A hardened ammonium nitrate body comprised of a combination of a single and/or a plurality of functionally active polymers and ammonium nitrate. The functionally active polymers may be comprised of organic polymers with a range of average molecular weight from about 200 to and through an upper range of 700,000. Preferably, the molecular weight is about 10,000 to and through an upper range of 200,000. Most preferably, the molecular weight is about 60,000 to and through about 150,000. The molecular weight of the polymers is determined by various means known to those skilled in the polymer art. The polymers of this invention may be combined as a homologous series and/or some combination thereof and/or therebetween. Polymers from all organic families are contemplated as useful and operative hereunder. Specifically, polymers such as acrylics, vinyl polymers, styrenes, polycarbonates, methacrylates, polypropylene, allyics, copolymers thereof such as maleic anhydride and polystyrene, combinations thereof and/or therebetween. Polymers such as acrylics and styrenes and copolymer polystyrenes, combinations thereof and/or therebetween are preferred. Most preferred is polystyrene. The polymers and/or copolymers hereof may be cross-linked, branched, linear, homopolymers, and/or combinations thereof and/or therebetween.

The functional activity provided to and ultimately by the polymer groups may be characterized as activity promoted by associated species. Associated species means any chemical group that is functionally operative within the polymer unit and/or associated thereby which enables film forming with, to, and/or on an ammonium nitrate body, makes an ionic association with the ammonium nitrate body, sorbs onto and/or throughout the ammonium nitrate surface and/or body, physico-chemical activity with the ammonium nitrate and/or body, combinations thereof and/or any chemical or physical force which enables communication between the ammonium nitrate and any of the polymers and/or copolymers cited herein.

The functional activity favors association with ammonium nitrate crystallites either as formed or promotes formation. The association relies on the operative mechanisms disclosed hereinabove, and provides communication between the polymer and the ammonium nitrate. The communication between polymer and ammonium nitrate need not be continuous throughout or with the polymer/ammonium nitrate interfaces thereby allowing for discontinuity between the two materials. It has been observed in the present invention that the polymer network may be continuously, discontinuously, and combinations thereof and/or therebetween in communication with the ammonium nitrate. Preferably, the communication is a combination of discontinuous and continuous.

The functionally active groups enabling communication are comprised of groups from inorganic species, organic species, and combinations thereof and/or therebetween. The inorganic species may be comprised of combinations of oxygen derived species such as nitrates, sulfates, sulfonates, phosphates, phosphites, phosphonates, and any operable oxyradical and/or oxygen derived species from the first, second, and/or third transition series of the Periodic Chart. Species that are preferred are those complex forming or moiety forming inorganic species that may advantageously combine with the organic polymer species. Preferably, sulfates, sulfonates, phosphates, and/or phosphonates. Most preferably, sulfonates and/or phosphonates. Organic species may be comprised of carboxylates, amines, hydroxyls, quaternary ammonium species, the di and/or tri combinations thereof, and/or combinations thereof and/or therebetween. Preferably, carboxylates, amines, and/or quaternary ammonium species. Most preferably, amines and/or quaternary amines. Useful combinations of these groups are sulfonates and amines, sulfonates and carboxylates, phosphonates and amines, phosphonates and carboxylates, sulfates and carboxylates, and combinations thereof.

The functionally active group may be introduced into the polymer as radicals or may be formed as radicals thereafter, or may be introduced as some ionic species, such as in a moiety, precursors thereof, and/or combinations thereof and/or therebetween. Preferably, the functionally active group is entered into the polymer as a radical. The functionally active group is added from about 0.0001 weight percent to about 10.0 weight percent of the ammonium nitrate, solubilized prior to the beginning of crystallization. Preferably, the functionally active group is added from about 0.0005 to 5.0 weight percent. Most preferably, the functionally active group is added from about 0.01 to about 1.0 weight percent.

Salts of the functionally active groups, such as sulfate and sulfonate salts, may be made as a combination of the polymer and functionally active group. Preferred examples of these salts are the monovalent salts, polystyrene sulfonate, polyvinyl sulfonate, polystyrene sulfonate copolymerized with maleic anhydride.

Optionally, a connecting group may be inserted between the polymer and the functionally active group. The connecting group may be a hydrocarbon of up to 8 carbons, which are preferred. While the present invention contemplates an upper limit of 8 carbons, preferably a linear chain, larger connecting groups may be operable, as well. The connecting group is a means to extend the distance between the polymer and functionally active group. Advantages from that extension may be realized by the addition of other kinds of connecting groups, but functionally the groups provide similar operability.

One of the present inventions more preferable embodiments may be presented by the following formula:

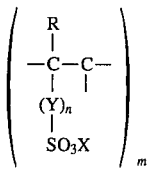

Wherein

Y=connecting group

R=hydrogen or methyl groups n=0 up to 8 m=integer from 3 to 3000

X=alkali metal, ammonium, hydrogen

Another advantage to the present invention is its film forming capability. Ammonium nitrate bodies that have been formed by the prior art, may be filmed with the present invention to form an AN body as a core/shell sphere or other geometric shape with enhanced hardness. The core may be comprised principally of AN or some combination of AN and some other common explosive and/or fertilizer known to those skilled in this art. Advantageously, the properties of the shell, which are derived from the polymer, may be varied to produce a shell with flexible density and/or hardness. Flexible density means that a range of different densities, either single and/or a plurality thereof, may be coated over a preexisting or as formed body. The density of the shell may be made to either match the core density and/or increase or decrease the density of the shell relative to the core. Density of the AN prill is an important property in the ultimate product use as an explosive. Density ranges of the shell may be from about 0.5 to about 1.7 grams per cubic centimeter. The density of the shell may be additionally varied by multi-filming the AN body to provide a shell of either several films of the same density or a shell of films with a range of varying densities.

Thickness of the shell may be on the order of 0.1 microns up to several millimeters thick. The shell composition may be either the functionally active polymer or a combination of functionally active polymer and AN. The shell composition may be combined with either granules or prills. Additionally, there is no requirement that the polymer shell be continuous. As stated hereinabove, it is preferred that the shell be a combination of continuous and discontinuous. Advantages to the addition of a polymer shell to the preexisting AN core are realized by reconditioning an AN body to be able to withstand certain environmental factors which heretofore would have made the AN body commercially unusable. Certain environmental factors decrease the shelf-life of an AN body, such as humidity and the mechanical abrasion associated with inventory manipulations and/or shipping environments. The present invention provides enhanced hardness to prolong the shelf-life and a means of reconditioning inventoried bodies.

The present invention may also be used to manufacture a core prill body. As those skilled in this art know, an AN body formed as a prill is made by internal crystallization of the AN during the formation of the prill. With the addition of the functionally active polymer, the prill should be able to maintain its porosity and increase its hardness throughout the prill body. This enhancement should provide the same shelf-life advantages disclosed hereinabove and additionally should provide the flexibility of density variation imparted by the polymer to the prill body.

It is further found advantageous to mix the product of the present invention with diesel fuel oil in a stoichiometric ratio to produce an explosive mixture commercially knonw as ANFO. The ANFO can be mixed with emulsion explosives at various ratios in order to produce ANFO doped emulsion explosives. Bodies of the present invention may also be mixed with emulsion explosives at various ratios in order to porduce AN doped emulsions. A problem in the emulsion art is the deterioration of the body in the emulsion after loading in a blasting hole. AN prills of the present invention may be mixed with various ratios such as 30, 45, 60, and 75 percent of emulsion compositions comprising 80 weight percent aqueous AN liquor, 0.7 weight percent PIBSA—diethanolamine derivative, 0.7 weight percent sorbitan monooleate and 4.6 weight percent diesel fuel oil. The emulsions can be made under low shear mixing conditions and produced to an average size of about 5 microns.

Generally, the means of combining the present invention is to place a polymer salt and ammonium nitrate ("AN") in a carrier solvent such as water to make a mixture, heat the mixture to solubilization to form the combination, disperse the combination by some means and slowly cool over time to room temperature to form AN bodies, such as prills or granules.

DETAILED DESCRIPTION OF EMBODIMENTS

The following is a further description of the present invention. The intent of this description is to further illustrate the invention and is not intended to limit the scope thereof.

EXAMPLE 1

In Example 1, 950 grams of commercially available AN (ammonium nitrate) was added to 40 grams of water and 10 grams of an aqueous solution of sodium polystyrene sulfonate (SPSS) approximately 0.2 weight percent, with a molecular weight of about 75,000 (obtained from Aldrich Chemicals, Milwaukee Wis.) subsequently charged into a jacketed vessel and melted at 130 degrees centigrade forming a liquor. The liquor was sprayed on to 1 kilogram of freshly made hot (50 to 70 degrees C.) AN prills over a period of 10 to 15 minutes in a thermally jacketed rotating pan. After completion of spraying the pan was heated by steam for 30 to 40 minutes in order to drive off moisture from the prills. The temperature decreased to room temperature over a 30 to 40 minute time period. The AN granules made from this method showed both porosity, enhanced hardness, and low friability.

EXAMPLE 2

In Example 2, the same procedure was used as in Example 1, except that 0.3 weight percent SPSS was added to the AN solution. The resulting AN granules exhibited the same improvements.

EXAMPLE 3

In Example 3, the same procedure was used as in Example 1, except that 1187.5 grams of AN, 50 grams of water, and 12.5 grams of SPSS with a molecular weight of about 130,000 (obtained from National Starch Chemical, N.J.) was charged into the jacketed vessel.

EXAMPLE 4

In Example 4, the same procedure was used as in Example 1, except 15 grams in 20% aqueous solution (0.3 weight percent) of polyvinyl sulfonate (obtained from Air Products, Pennsylvania) with a molecular weight of approximately 70,000 was added to the mixture.

EXAMPLE 5

Example 5, is an example of the use of the present invention in the manufacture of prill. A hot liquor containing 95 weight percent AN, 1 weight percent SPSS (20% aqueous solution) and 4 weight percent water may be made in a tank of 200 Kg capacity at 140 degrees C. The hot liquor may be pumped to an overhead tank of a prilling tower with a height of 8 meters and then may be sprayed through a vibrated sieved plate to produce a shower of droplets with an average diameter of 1.7 mm. The droplets so formed will fall through a moving air stream and solidify during flight. The solidified droplet will be the prill.

The following methods were used to determine the properties of the present invention.

Particle density of the AN body was measured by mercury pyknometry measured in grams per cubic centimeter. This technique provides semi-quantitative results of the voids present. It is a good technique when comparisons are made on a sample to sample basis. Samples are placed in a holder and mercury is pumped into the holder with the sample. The resulting volume differential between mercury with and without sample is used to determine the sample density.

Crushing strength, which is a measure of hardness, is determined by placing a constant load on a sample until the sample either cracks or is crushed and is measured in pounds or kilograms. The data is taken on a TSDC Chatillon obtained from Digital Measurement Metrology Inc. in Canada.

Friability is a measure of the abrasion resistance of the ammonium nitrate body which is partially dependent upon the compactness of the crystal structure at the surface of the body. Friability is determined by the percent fines (powder which comes off the body) generated after the body is subjected to an air cyclone. This is a standard method, known to those skilled in the art and gives a measure of surface hardness.

The Table exhibits results from tests performed on the present invention.

| | Crushing Strength | Friability | Particle Density |
|---|---|---|---|
| Example | | | |
| 1 | 5.7–6.8 | 0.5–3.5 | 1.17 |
| 3 | 6–6.72 | 0.5–3.5 | 1.18 |
| 4 | 3.8 | 5–8 | |
| Comparative Example | | | |
| 1A | 2.1 | 18 | 1.23 |
| 3A | 2–3 | — | 1.46 |
| 4A | 2–3 | — | 1.46 |

The Table indicates that hardness or crushing strength is increased for the samples treated with the functionally active polymers since the samples were able to withstand a larger crushing weight. The increase in hardness is from two to three times the hardness of the comparative examples. Note that the density of the inventive samples is less than that of the comparative samples by a significant amount, indicating that the inventive samples do not derive their hardness from density considerations. The comparative examples cited hereinabove, were made in a manner similar to Example 1, except that no polymer was added to the combination.

I claim:

1. A hardened ammonium nitrate body, which is a combination of a functionally active polymer and ammonium nitrate, wherein said functionally active polymer has the formula:

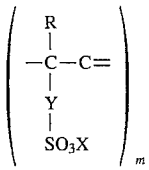

Wherein

Y=phenylene

R=hydrogen or methyl m=integer from 3 to 3000

X=alkali metal, ammonium, hydrogen, and further wherein the body has a core/shell structure with ammonium nitrate being the core and said polymer being the shell.

2. The body of claim 1 wherein said functionally active polymer has an average molecular weight of from about 200 to about 700,000.

3. The body of claim 1 wherein said functionally active polymer has an average molecular weight of from about 10,000 to about 200,000.

4. The body of claim 1 wherein said functionally active polymer has an average molecular weight of from about 60,000 to about 150,000.

5. The body of claim 1 wherein said core is a preexisting ammonium nitrate body reconditioned by addition of said shell.

6. The shell of claim 1 wherein said shell is continuous or discontinuous.

7. The body of claim 1 wherein said core is an AN prill.

8. The hardened ammonium nitrate of claim 1 wherein said hardened ammonium nitrate is combined with ingredients including diesel fuel to form an emulsion explosive.

9. The body of claim 1 wherein said body is a prill.

10. The body of claim 1 wherein said body is combined to form an explosive.

11. The body of claim 1 wherein said body is a granule.

12. The hardened ammonium nitrate of claim 1, wherein said polymer is crosslinked or not crosslinked, linear or branched, a homopolymer or copolymer, or combinations thereof.

* * * * *